US010888157B2

(12) United States Patent
Koenig et al.

(10) Patent No.: US 10,888,157 B2
(45) Date of Patent: Jan. 12, 2021

(54) DRAWER GUIDE

(71) Applicant: Schock Metallwerk GmbH, Urbach (DE)

(72) Inventors: Hubert Koenig, Durlangen (DE); Rudolf Wiegold, Rudersberg (DE); Joachim Zimmermann, Schorndorf (DE)

(73) Assignee: Schock Metallwerk GmbH, Urbach (DE)

( * ) Notice: Subject to any disclaimer, the term of this patent is extended or adjusted under 35 U.S.C. 154(b) by 0 days.

(21) Appl. No.: 16/276,707

(22) Filed: Feb. 15, 2019

(65) Prior Publication Data

US 2019/0246795 A1 Aug. 15, 2019

Related U.S. Application Data

(63) Continuation of application No. PCT/EP2017/071348, filed on Aug. 24, 2017.

(30) Foreign Application Priority Data

Sep. 6, 2016 (DE) ..... 10 2016 216 904

(51) Int. Cl.
*A47B 88/00* (2017.01)
*A47B 88/493* (2017.01)
*A47B 88/437* (2017.01)

(52) U.S. Cl.
CPC ..... *A47B 88/493* (2017.01); *A47B 88/437* (2017.01); *A47B 2210/0021* (2013.01); *A47B 2210/0032* (2013.01); *A47B 2210/0056* (2013.01); *A47B 2210/0059* (2013.01)

(58) Field of Classification Search
CPC ..... A47B 88/493; A47B 88/437; A47B 2210/0021; A47B 2210/0032; A47B 2210/0059; A47B 2210/0056
USPC ..... 312/334.11, 334.4, 334.6, 334.7, 334.13, 312/334.14, 334.15, 334.32, 334.29, 331, 312/332
See application file for complete search history.

(56) References Cited

U.S. PATENT DOCUMENTS 1,680,081 A * 8/1928 Bergmann ..... A47B 88/493 384/18
1,686,783 A * 10/1928 Wolters ..... A47B 88/493 312/334.12
1,902,795 A * 3/1933 Wolters ..... A47B 88/493 312/331
1,994,424 A 5/1933 Brantingson
(Continued)

FOREIGN PATENT DOCUMENTS

DE 4223682 * 3/1993
DE 102006061096 * 6/2008
(Continued)

*Primary Examiner* — Janet M Wilkens
(74) *Attorney, Agent, or Firm* — Lipsitz & McAllister, LLC

(57) ABSTRACT

A drawer guide for guiding a drawer which is extendable out of a carcass in an extension direction is provided with a guidance unit configured as a vertical guidance unit and a guidance unit configured as a lateral guidance unit. The two guidance units each comprise a carcass-side guidance rail and a drawer-side guidance unit mounted on rolling bodies. The two guidance units are coupled to each other by a coupling device.

12 Claims, 6 Drawing Sheets

(56) References Cited

U.S. PATENT DOCUMENTS

| | | | | | |
|---|---|---|---|---|---|
| 3,094,363 | A * | 6/1963 | Gorton | A47B 88/487 | 312/334.4 |
| 3,275,396 | A * | 9/1966 | Hillson | A47B 88/43 | 312/334.17 |
| 3,298,768 | A * | 1/1967 | Vogt | F16C 29/045 | 312/334.12 |
| 4,285,560 | A | 8/1981 | Miller | | |

FOREIGN PATENT DOCUMENTS

| | | | | |
|---|---|---|---|---|
| DE | 202008010779 | | 1/2010 | |
| EP | 2153749 | A2 * | 2/2010 | A47B 88/40 |
| JP | 2010112 | | 1/2010 | |

* cited by examiner

DRAWER GUIDE

RELATED APPLICATION

This application is a continuation of international application No. PCT/EP2017/071348 filed on Aug. 24, 2017, and claims the benefit of German application No. 10 2016 216 904.1 filed on Sep. 6, 2016, which are incorporated herein by reference in their entirety and for all purposes.

FIELD OF DISCLOSURE

The present invention relates to a drawer guide which is used, in particular, in furniture construction and mechanical engineering, as well as in the field of white goods. A drawer guide serves in particular for guiding a drawer which is extendable out of a carcass in an extension direction.

SUMMARY OF THE INVENTION

The object underlying the present invention is to provide a drawer guide which is stably formed and enables the reliable guidance of drawers with an unfavorable width-depth ratio.

This object is achieved in accordance with the invention by a drawer guide in accordance with Claim 1.

The drawer guide in accordance with the invention is a drawer guide for guiding a drawer which is extendable out of a carcass in an extension direction.

The drawer guide preferably comprises a guidance unit configured as a vertical guidance unit and a guidance unit configured as a lateral guidance unit.

The two guidance units preferably each comprise a carcass-side guidance rail and a drawer-side guidance rail mounted on rolling bodies.

The two guidance units are preferably coupled to each other by means of a coupling device.

A vertical guidance unit is in particular a guidance unit of the kind such that a maximum force absorption for guiding the drawer in at least approximately vertical direction is possible.

The vertical guidance unit preferably serves in the usage state of the drawer guide for absorbing the weight force of the drawer and the contents located therein.

The lateral guidance unit preferably serves for directional stabilization and/or lateral stabilization and in the assembled state of the drawer guide preferably absorbs no or only small weight forces of the drawer and the contents located therein.

The vertical guidance unit and the lateral guidance unit of a drawer guide are preferably together associated with one of two sides of the drawer to be guided. In particular, associated with the further of the two sides of the drawer to be guided is a further drawer guide which in particular comprises a further vertical guidance unit and/or a further lateral guidance unit.

The at least one guidance unit preferably comprises at least one central rail which is arranged between the carcass-side guidance rail and the drawer-side guidance rail. The at least one central rail is in particular mounted on the carcass-side guidance rail by means of rolling bodies and is displaceable relative to the same. The drawer-side guidance rail is in particular mounted on the at least one central rail by means of rolling bodies and is displaceable relative to the same.

Each guidance unit preferably comprises at least one central rail.

In particular, the guidance units each comprise identical numbers of guidance rails, i.e. in each case one carcass-side guidance rail, one drawer-side guidance rail, and at least one central rail. However, different numbers of guidance rails may be provided for the guidance units.

The formulations selected in this description and the appended claims, "vertical", "horizontal", "up", "down", etc., are in relation in particular to the assembled state of the drawer guide and/or a usage state of the drawer guide. In particular, the terms "up" and "down", etc. are hereby preferably interchangeable with each other, depending on the installation situation of the drawer guide.

In one configuration of the invention, provision may be made for the carcass-side guidance rails of the two guidance units to be connected to each other by means of the coupling device so as to be immovable in relation to the extension direction.

Alternatively or in addition hereto, provision may be made for the drawer-side guidance rails of the two guidance units to be connected to each other by means of the coupling device so as to be immovable in relation to the extension direction.

As a result, the guidance units may in particular together be brought into an extended as well as an inserted state.

A relative movement of the carcass-side guidance rails relative to each other along the extension direction is hereby preferably effectively prevented.

Alternatively or in addition hereto, provision may be made for a relative movement of the drawer-side guidance rails relative to each other along the extension direction to be effectively prevented.

It may be favorable if the carcass-side guidance rails of the two guidance units are connected to each other by means of the coupling device so as to be immovable in relation to a spatial direction aligned perpendicular to the extension direction.

Alternatively or in addition hereto, provision may be made for the drawer-side guidance rails of the two guidance units to be connected to each other by means of the coupling device so as to be immovable in relation to a spatial direction aligned perpendicular the extension direction.

For this purpose, an optimized force transmission in a spatial direction aligned perpendicular to the extension direction is preferably possible in order to, for example, stabilize one of the guidance units, in particular the vertical guidance unit, in said spatial direction aligned perpendicular to the extension direction by means of the further guidance unit, in particular the lateral guidance unit.

Provision may be made for the carcass-side guidance rails of the two guidance units to be connected to each other by means of the coupling device so as to be immovable in relation to all spatial directions.

Alternatively or in addition hereto, provision may be made for the drawer-side guidance rails of the two guidance units to be connected to each other by means of the coupling device so as to be immovable in relation to all spatial directions.

However, it may be favorable if the carcass-side guidance rails of the two guidance units are connected to each other by means of the coupling device so as to be movable in relation to a spatial direction aligned perpendicular to the extension direction.

Alternatively or in addition hereto, provision may be made for the drawer-side guidance rails of the two guidance units to be connected to each other by means of the coupling device so as to be moveable in relation to a spatial direction aligned perpendicular the extension direction.

As a result, in particular a relative movement of the carcass-side guidance rails and the drawer-side guidance rails, respectively, of the two guidance units relative to each other in a spatial direction is made possible in which no stabilizing function is necessary.

In particular, provision may be made for the carcass-side guidance rails of the two guidance units to be connected to each other so as to be immovable in relation to all spatial directions, while the drawer-side guidance rails of the two guidance units are connected to each other so as to be immovable in only two spatial directions running perpendicular to each other. The one spatial direction in which the drawer-side guidance rails are moveably connected to each other is then in particular a vertical spatial direction, i.e. the direction of gravity.

Alternatively to the embodiment stated above, provision may be made for the drawer-side guidance rails of the guidance units to be connected to each other so as to be immovable in relation to all spatial directions. The carcass-side guidance rails of the guidance units are then preferably connected to each other so as to be immovable in only two spatial directions running perpendicular to each other. The one spatial direction in which the carcass-side guidance rails are moveably connected to each other is then preferably a vertical direction, in particular the direction of gravity.

One or multiple or all coupling elements may preferably be formed by the carcass.

Further, one or multiple or all coupling elements may be formed by the drawer.

The one or the multiple or all the coupling elements are preferably elements different from the carcass and/or the drawer.

It may be advantageous if the coupling device comprises one or more coupling elements which are fixed on both sides on rail backs of the carcass-side guidance rails.

Alternatively or in addition hereto, provision may be made for the coupling device to comprise one or more coupling elements which are fixed on both sides on rail backs of the drawer-side guidance rails.

The one or more coupling elements are hereby preferably each fixed at one end on a rail back of a carcass-side guidance rail of a guidance unit and at the other end on a rail back of the carcass-side guidance rail of the further guidance unit.

Alternatively or in addition hereto, provision may be made for one or more coupling elements to each be fixed, on the one hand, on a rail back of the drawer-side guidance rail of a guidance unit and, on the other hand, on a rail back of the drawer-side guidance rail of the further guidance unit.

The coupling device preferably comprises two or more than two coupling elements which are brought or able to be bought into engagement with each other for coupling two guidance rails. The two or more than two coupling elements are preferably moveable relative to each other in one or more spatial directions, in particular in exactly one spatial direction.

One of the coupling elements preferably comprises a pin or is configured as a pin.

A further one of the coupling elements preferably has a through-opening for accommodating and/or guiding the pin.

The pin and/or the through-opening may be provided, in particular protected, e.g., with an additional element. The additional element preferably comprises a plastics material or is formed therefrom and serves in particular for reducing friction and/or for reducing a development of noise upon a movement of the coupling elements relative to each other.

The additional element may, for example, be a guidance ring which surrounds the pin and prevents a direct contact of the pin with the coupling element having the through-opening. The guidance ring may hereby be immovably fixed on the pin or on the coupling element having the through-opening.

The two or more than two coupling elements preferably form a floating bearing connection for connecting two guidance rails of the two guidance units in such a way that the same are preferably moveable relative to each other in relation to only one spatial direction. This spatial direction is in particular the vertical spatial direction.

One or more coupling elements are preferably of substantially L-shaped configuration.

Preferably a section of one such coupling element, extending substantially vertically, is fixed on a guidance rail, in particular a rail back of a guidance rail, of the vertical guidance unit.

A horizontal section of one such coupling element is preferably fixed on a guidance rail, in particular a rail back of a guidance rail, of the lateral guidance unit.

One or more coupling elements are formed, e.g., of a metallic material and/or a plastics material or comprise a metallic material and/or a plastics material.

For example, the one or more coupling elements are sheet metal bending products.

For connecting two guidance rails of the two guidance units so as to be immovable in relation to all spatial directions, for example exactly two or exactly three coupling elements are provided.

For fixing two further guidance rails of the two guidance units so as to be moveable in only one spatial direction, in particular two coupling elements which are brought or able to be brought into engagement with each other are provided two or three times.

The coupling device preferably comprises one or more coupling elements which each have one or more stiffening ribs. As a result, in particular a stabilization of the respective coupling element may be achieved in order to ultimately stabilize the guidance rails relative to each other, which are connected to each other by means of said one or more coupling elements.

One or more coupling elements of the coupling device, by means of which the carcass-side guidance rails of the guidance units are connected to each other, are in particular mountable directly on a carcass. In the assembled state of the drawer guides, said one or more coupling elements preferably abut directly against the carcass.

The carcass-side guidance rails of the two guidance units are then preferably fixed or fixable indirectly on the carcass by means of said one or more coupling elements.

One or more coupling elements of the coupling device for coupling the drawer-side guidance rails of the two guidance units are preferably mountable directly on the drawer. For example, the drawer may be fixed, for example hung, latched, etc., directly on one or more coupling elements for coupling the drawer-side guidance rails of the two guidance units. In the assembled state of the drawer guide, the drawer is preferably fixed indirectly on the drawer-side guidance rails by means of said one or more coupling elements.

The guidance rails of the vertical guidance unit preferably have at least one rail back which each connects two legs of the respective guidance rail to each other. The rail backs of the guidance units of the vertical guidance unit are preferably aligned at least approximately vertical.

The legs of the guidance rails preferably comprise or form rolling body tracks for accommodating and guiding the rolling bodies.

The term "at least approximately" is to be understood in this description and the appended claims in particular as a deviation of at most about 20%, preferably at most about 10%, for example at most about 5%, of the specified value.

It may be favorable if the guidance rails of the lateral guidance unit each have at least one rail back which each connects two legs of the respective guidance rail to each other. The rail backs of the guidance rails of the lateral guidance unit are preferably aligned transverse to a vertical direction, in particular at least approximately horizontal.

The lateral guidance unit is preferably arranged entirely beneath or entirely above the vertical guidance unit.

In particular, the lateral guidance unit and the vertical guidance unit are preferably arranged entirely one above the other or one beneath the other.

The drawer guide in accordance with the invention is suited in particular for use in combination with a carcass, a drawer, and a further drawer guide.

The present invention therefore also relates to a combination which comprises the following:

a carcass, a drawer which is extendable out of the carcass in an extension direction, and two drawer guides, in particular drawer guides in accordance with the invention for accommodating and guiding the drawer.

The combination is in particular a cabinet-like piece of furniture or cabinet-like machine part or household appliance or a component of a piece of furniture or of a machine or of a household appliance.

The drawer guides together with the drawer form in particular full-extension drawers in which the drawer is at least approximately entirely extendable out of the carcass. Further, the drawer guides together with drawer may form a partial-extension drawer in which the drawer is only partially extendable out of the carcass and remains in the carcass at least at least in sections, even in the fully-extended state of the drawer guides.

Further, provision may be made for the drawer guides together with the drawer to form an over-extension drawer in which the drawer is extendable entirely out of the carcass and moreover is further removable from the carcass.

The combination in accordance with the invention preferably has individual or multiple of the features and/or advantages described in conjunction with the drawer guide in accordance with the invention.

It may be favorable if a width of the drawer corresponds to at least about 1.5 times, preferably at least about 2 times, a length of the drawer.

A width of the drawer is hereby in particular at least approximately a maximum horizontal distance between the two drawer guides. A length of the drawer is in particular a maximum extension thereof along the extension direction.

A maximum extension length and/or a maximum extension path of the two drawer guides preferably corresponds to at most about 0.8 times a width of the drawer.

The two drawer guides are preferably formed and/or arranged mirror-symmetrical to each other in relation to a vertical center plane of the drawer, running parallel to the extension direction.

The two drawer guides are preferably not forcibly coupled. Rather, the only connection between the two drawer guides is preferably produced by the drawer.

In particular, a toothed rod coupling which is typical in conventional drawer guides for wide drawers for uniform movement of the drawer guides is preferably expendable.

In particular, a load-related lowering of the drawer-side guidance rails of the vertical guidance units of the two drawer guides is preferably possible independently of a vertical load or a vertical deformation or movement of the drawer-side guidance rails of the lateral guidance units of the two drawer guides.

The lateral guidance units of the two drawer guides may thus preferably serve exclusively for the lateral stabilization and reliable guidance of the drawer and are thereby preferably not loaded by high weight forces which act on the drawer and are substantially entirely absorbed by the vertical guidance units.

Further preferred features and/or advantages of the invention are the subject matter of the subsequent description and the illustrative depiction of an exemplary embodiment.

BRIEF DESCRIPTION OF THE DRAWINGS

The same or functionally equivalent elements are provided with the same reference numerals in all Figures.

DETAILED DESCRIPTION OF THE DRAWINGS

Figure 6:
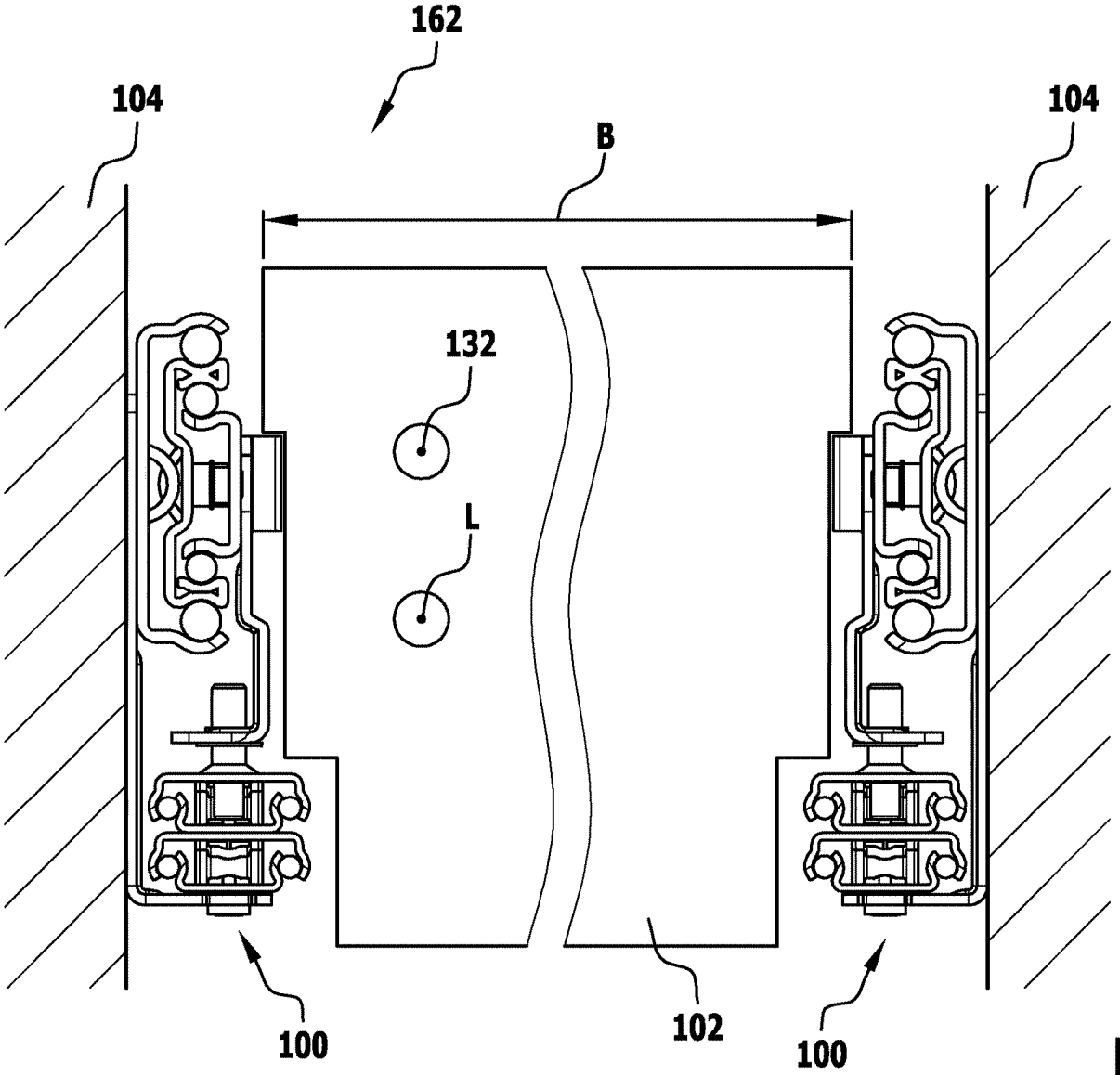
FIG. 6 shows a schematic depiction of a combination of carcass, drawer, and drawer guide.

An embodiment, depicted in FIGS. 1 to 6, of a drawer guide designated as a whole with 100 serves to guide a drawer 102 relative to a carcass 104 (see FIG. 6).

The drawer 102 is hereby in particular able to be extended out of an inner space of the carcass 104 and inserted into the same.

The drawer guide 100 comprises multiple guidance rails which are moveable relative to each other.

In particular, the drawer guide 100 comprises two carcass-side guidance rails 106 which in the assembled state of the drawer guide 100 are fixed on the carcass 104. Further, the drawer guide 100 comprises two drawer-side guidance rails 108 which in the assembled state of the drawer guide 100 are fixed on the drawer 102.

In each case one central rail 110 is provided between in each case one carcass-side guidance rail 106 and one drawer-side guidance rail 108. The drawer guide 100 thus preferably comprises two central rails 110.

Figure 3:
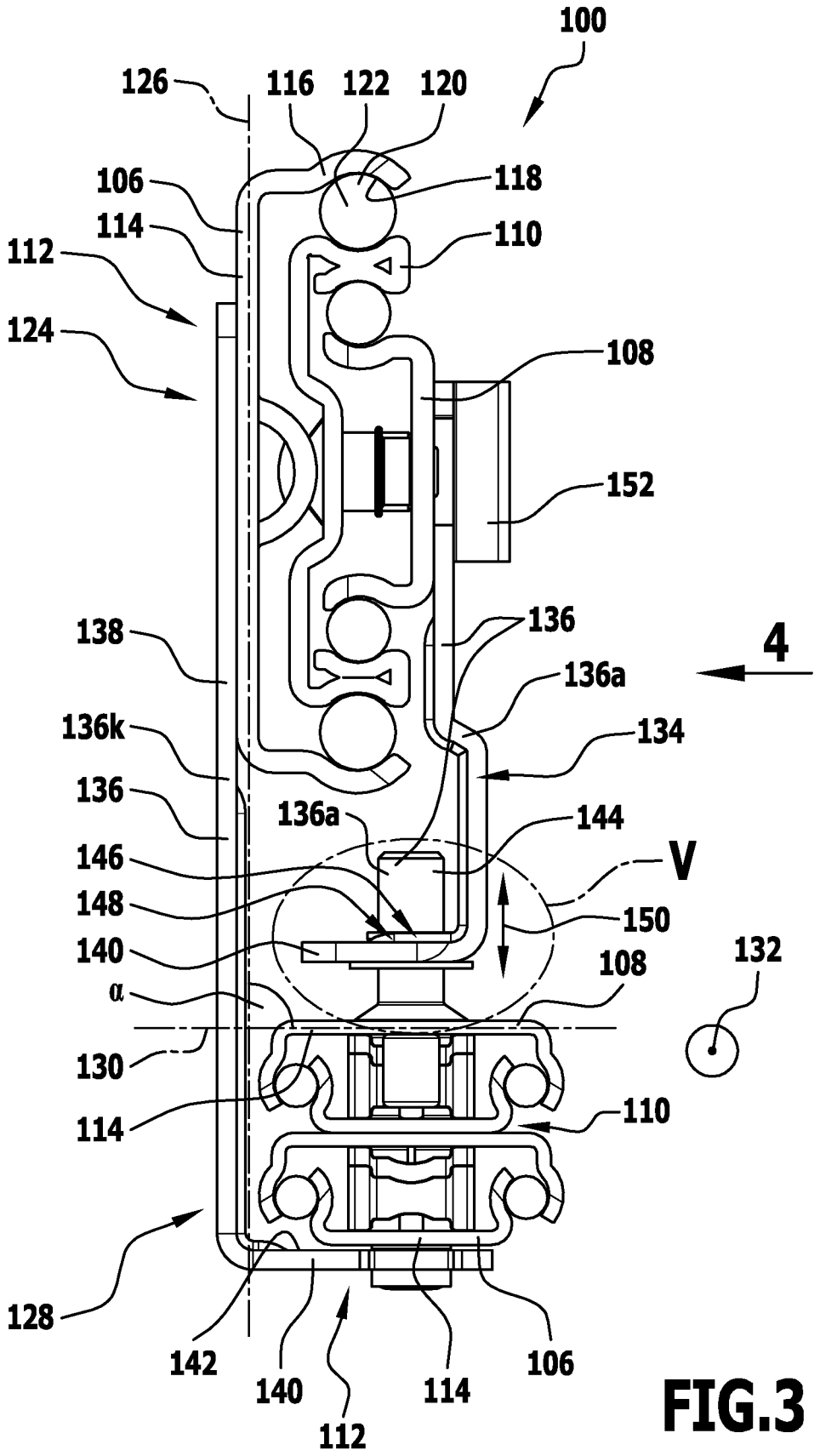
FIG. 3 shows a schematic frontal view of the drawer guide from FIG. 1 with viewing direction opposite an extension direction.

As may be gathered in particular from FIG. 3, two groups of in each case one carcass-side guidance rail 106, one drawer-side guidance rail 108, and one central rail 110 are provided. Each of these groups is subsequently referred to as a guidance unit 112.

The guidance rails 106, 108, 110 preferably each have a substantially C-shaped cross section at least in sections.

Each guidance rail 106, 108, 110 hereby preferably comprises a rail back 114 which each connects at least two legs 116 of the respective guidance rail 106, 108, 110 to each other.

The legs 116 serve in particular as rolling body tracks 118 of the guidance rails 106, 108, 110 and thus for accommodating rolling bodies 120 of the drawer guide 100.

The rolling bodies 120 are in particular guided in rolling body cages (not depicted) and enable a simple movement of the guidance rails 106, 108, 110 relative to each other.

The rolling bodies 120 are in particular balls 122 or cylinders.

The two guidance units 112 of the drawer guide 100 differ in particular in their alignment and thus in the direction in which the maximum forces are able to be absorbed and/or transmitted.

A guidance unit 112 is preferably configured as a vertical guidance unit 124.

In said vertical guidance unit 124, provision in made in particular for the rail backs 114 of the guidance rails 106, 108, 110 of the vertical guidance unit 124 to run at least approximately along a plane 126 which is aligned at least approximately vertical.

All rolling bodies 120 of the vertical guidance unit 124 are thereby preferably arranged one above the other in vertical direction 158.

High weight forces of the drawer 102 are preferably absorbable and/or transmittable by means of the vertical guidance unit 124.

A further guidance unit 112 is preferably configured as a lateral guidance unit 128.

The lateral guidance unit 128 comprises in particular guidance rails 106, 108, 110, the rail backs 114 of which are aligned transverse to the vertical direction 158, for example at least approximately in horizontal direction 160.

In particular, a plane 130 in which a rail back 114 of the drawer-side guidance rail 108 of the lateral guidance unit 128 extends preferably runs at least approximately horizontal.

The rail backs 114 of the two guidance units 112 are thus preferably aligned transverse to each other, in particular at least approximately perpendicular to each other.

By means of the lateral guidance unit 128, an optimal force absorption and/or force transmission in horizontal direction 160 may preferably be achieved as a result.

The two guidance units 112 may thus supplement each other in the usage state of the drawer guide 100 in order to enable an optimal guidance of the drawer 102 along an extension direction 132.

For this purpose, the guidance units 112 are coupled to each other by means of a coupling device 134.

The coupling device 134 comprises in particular multiple coupling elements 136 for coupling guidance rails 106, 108, 110 of mutually different guidance units 112.

For example, the coupling device 134 comprises two coupling elements **136*k* by means of which the carcass-side guidance rails 106 of the two guidance units 112** are coupled to each other.

For example, the two carcass-side guidance rails 106 of the two guidance units 112 are firmly connected to each other by means of the coupling elements **136*k*** so as to be immovable in relation to all spatial directions.

The two coupling elements **136*k*** hereby preferably each have an L-shape.

An at least approximately vertical section 138 of each one coupling element **136*k* is preferably arranged on a rail back 114 of the carcass-side guidance rail 106 of the vertical guidance unit 124**, in particular on the outer side thereof.

An at least approximately horizontal section 140 of each one coupling element **136*k* is preferably fixed on a rail back 114 of the carcass-side guidance rail 106 of the lateral guidance unit 128**, in particular on the outer side thereof.

The lateral guidance unit 128 is in particular arranged on an, in relation to the vertical direction 158, overhead upper side 142 of the at least one approximately horizontal section 130 of each one coupling element **136*k***.

The coupling device 134 further preferably comprises multiple coupling elements **136*a* for coupling the drawer-side guidance rail 108 of the vertical guidance unit 124 to the drawer-side guidance rail 108 of the lateral guidance unit 128**.

Hereby preferably in each case two coupling elements **136*a* are provided which are brought or able to be brought into engagement with each other into order to couple the two drawer-side guidance rails 108 of the two guidance units 112** to each other.

The two coupling elements **136*a* of each one pair of coupling elements 136*a*** are hereby preferably moveable relative to each other in exactly one spatial direction and simultaneously are fixed relative to each other in the two further spatial direction aligned perpendicular to said first spatial direction.

By means of each one pair of coupling elements **136*a*, the drawer-side guidance rails 108 of the two guidance units 112** are thus preferably moveable relative to each other in relation to a spatial direction and simultaneously are fixed relative to each other in the two spatial directions running perpendicular to each other and perpendicular to said first spatial direction.

A coupling element **136*a* of one pair of coupling elements 136*a* is configured, e.g., as a pin 144**.

The further coupling element **136*a* of a pair of coupling elements 136*a* preferably comprises a receptacle 146 for accommodating said pin 144**.

The receptacle 146 is configured in particular as a through-opening 148 in an at least approximately horizontal section 140 of an L-shaped coupling element **136*a***.

In the assembled state of the drawer guide 100, the pin 144 extends in particular in or counter to a movement direction 150 into the receptacle 146, in particular through the through-opening 148.

The movement direction 150 is in particular that direction in relation to which the two coupling elements **136*a* of a pair of coupling elements 136*a* and consequently also the two drawer-side guidance rails 108 of the two guidance units 112** are moveable relative to each other.

The movement direction 150 is in particular aligned at least approximately vertical.

In the assembled state of the drawer guide 100, the two carcass-side guidance rails 106 of the two guidance units 112 are fixed on the carcass 104 in particular by means of the coupling elements **136*k* connected said carcass-side guidance rails 106** to each other.

For fixing the drawer 102 on the drawer-side guidance rails 108 of the guidance units 112, one or more drawer receptacles 152 are preferably provided.

The one or more drawer receptacles 152 are in particular hanging-in tabs for hanging in the drawer 102.

The drawer receptacles 152 are preferably arranged on coupling elements **136*a* of the coupling device 134**.

In particular, the drawer receptacles 152 are arranged on those coupling elements **136*a* which are immovably fixed on the drawer-side guidance rails 108 of the vertical guidance unit 124**.

The entire drawer 102 is thus preferably accommodated so as to be moveable relative to the lateral guidance unit 128 in the movement direction 150.

Figure 1:
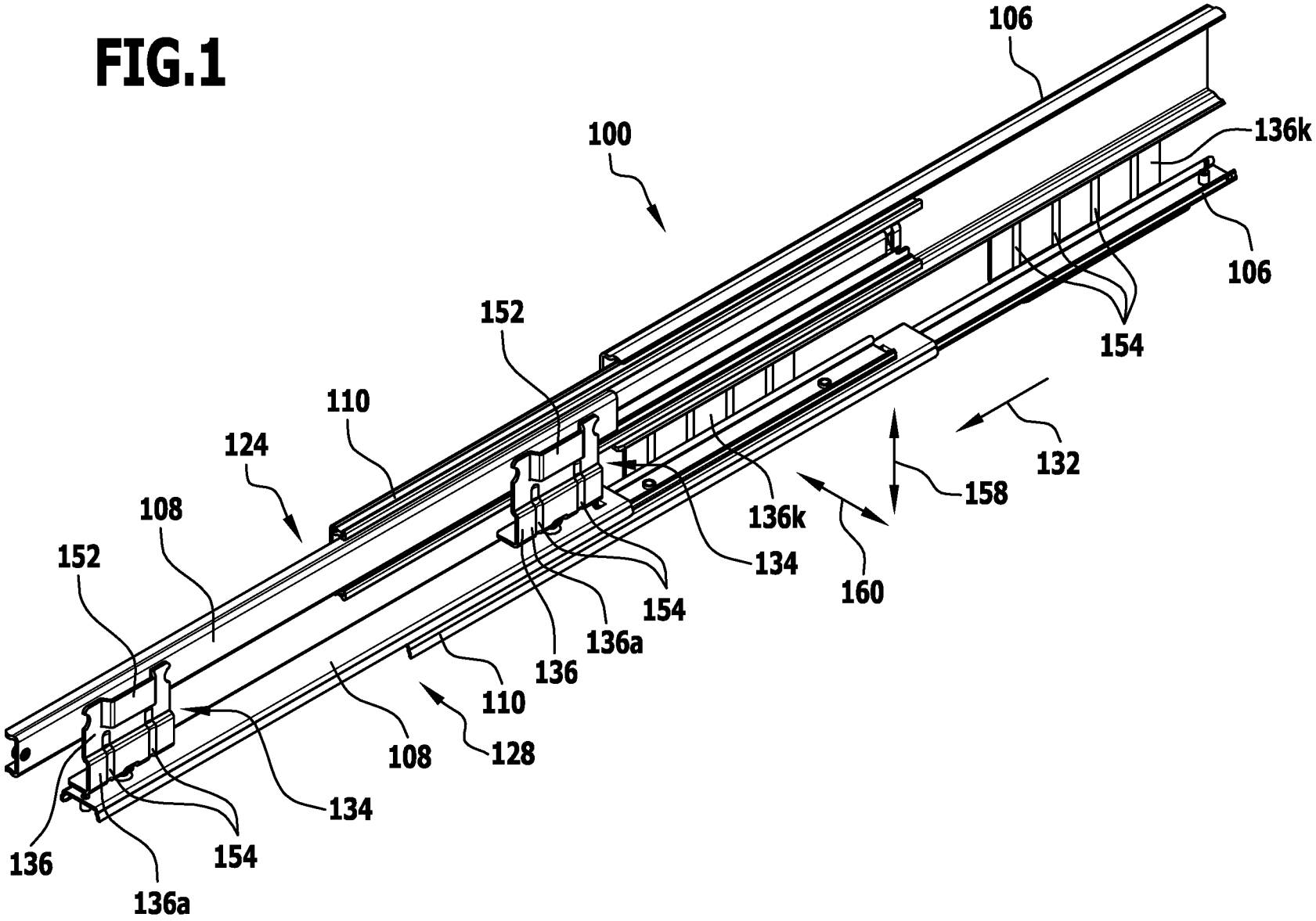
FIG. 1 shows a schematic perspective depiction of a drawer guide which comprises two guidance units which are coupled to each other by means of a coupling device.
Figure 2:
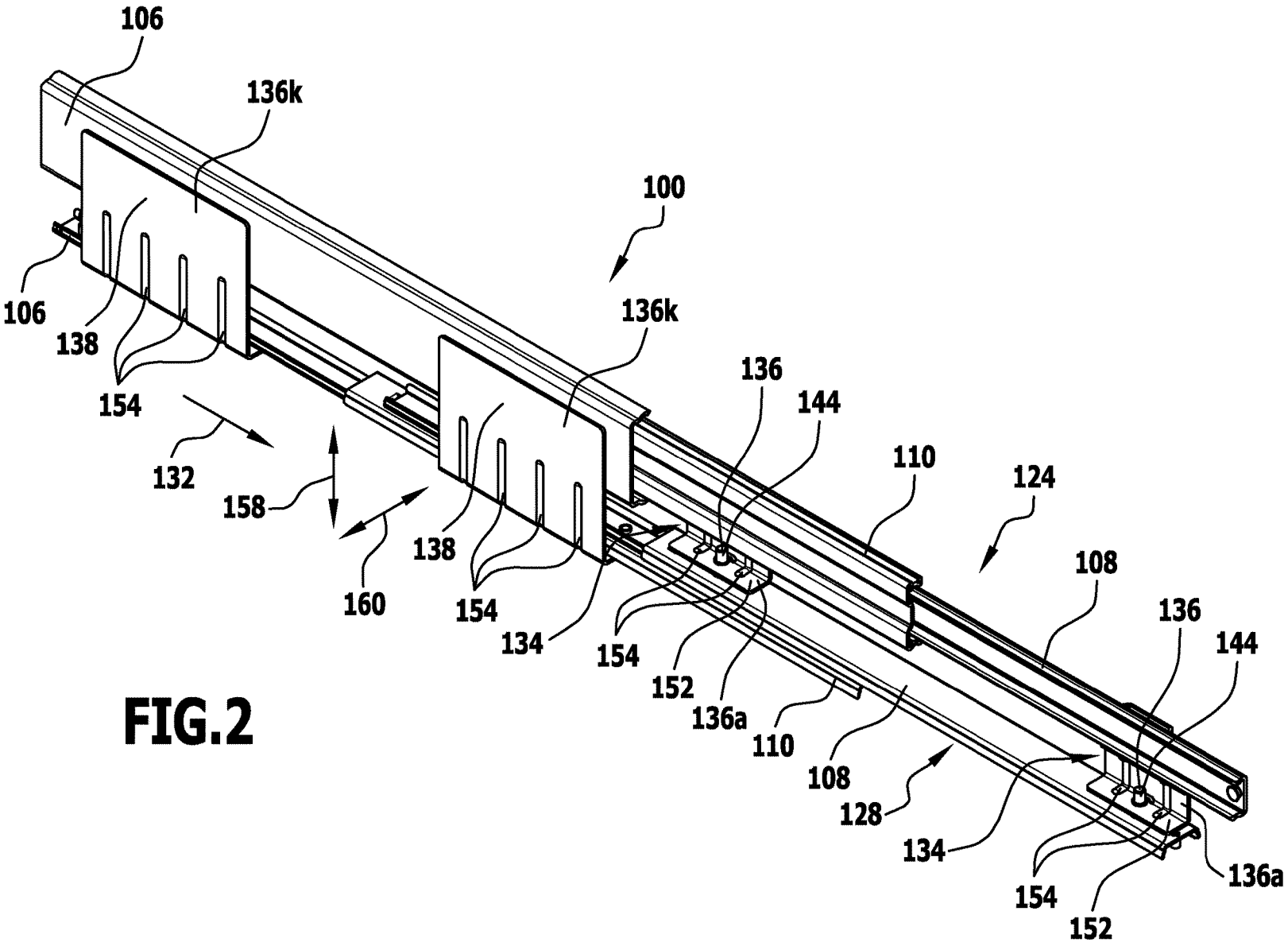
FIG. 2 shows a further schematic perspective depiction of the drawer guide from FIG. 1.

As may be gathered in particular from FIGS. 1 and 2, the one or more coupling elements 136 preferably each comprise one or more stiffening ribs 154 which in particular are aligned at least approximately vertical. As a result, a stable configuration of the coupling elements 136 may be ensured, even with low material thickness of the material for the production of the coupling elements 136.

The functioning of the drawer guide 100 is subsequently described in particular with reference to FIG. 4.

Figure 4:
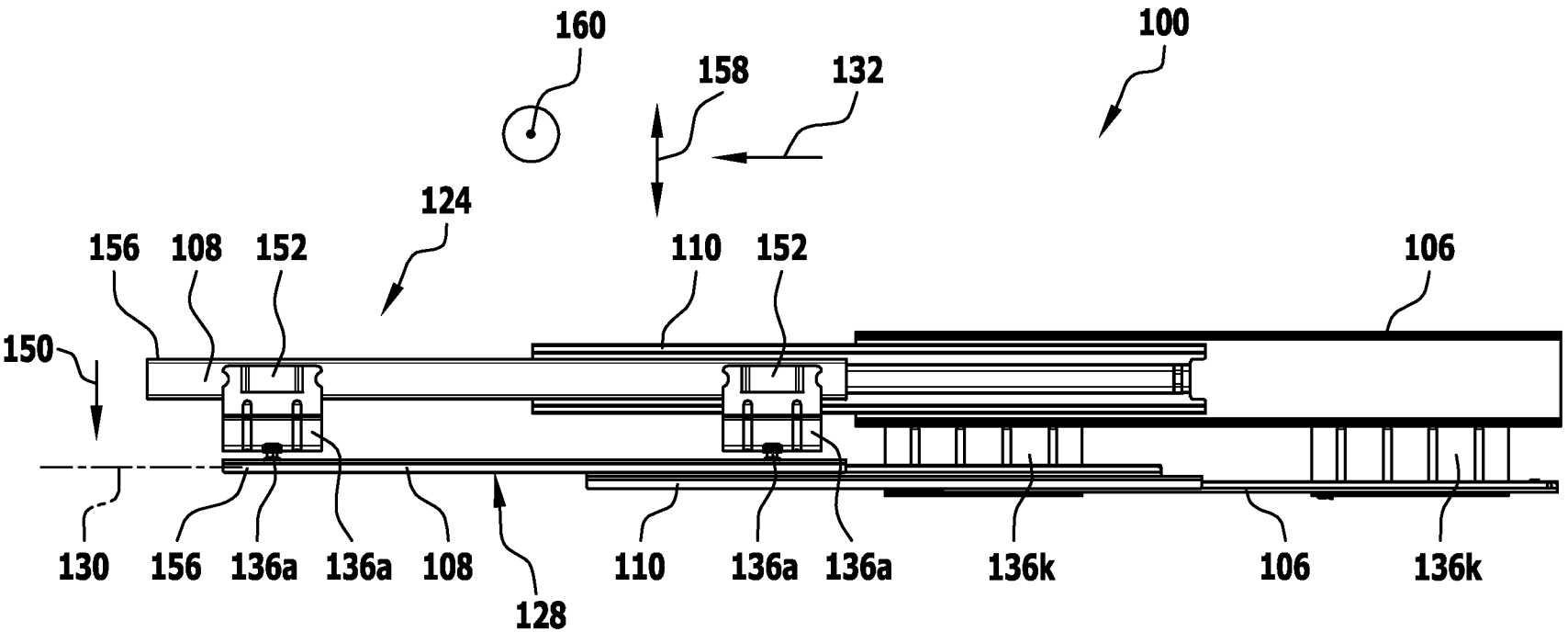
FIG. 4 shows a schematic side view of the drawer guide from FIG. 1 with viewing direction in the direction of arrow 4 in FIG. 3.
Figure 5:
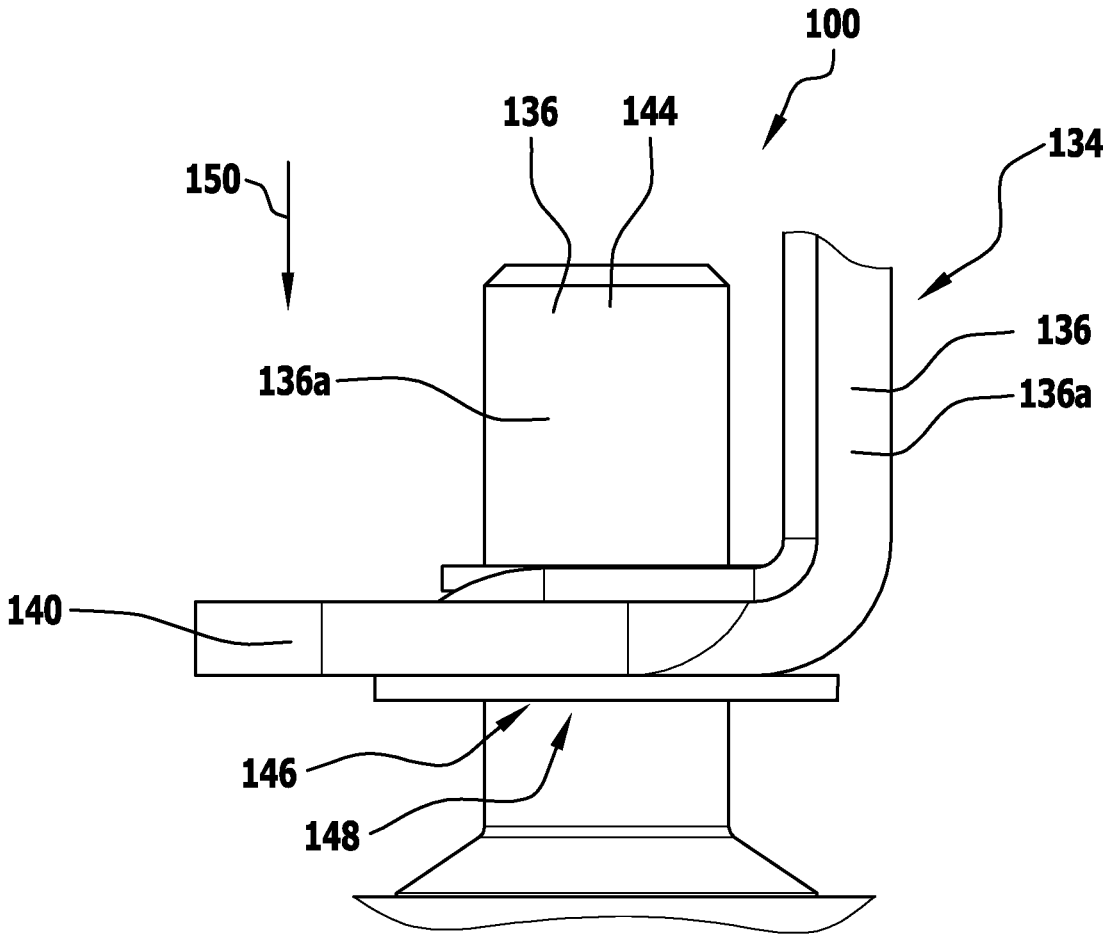
FIG. 5 shows an enlarged depiction of the region V in FIG. 3.

In the fully extended state of the drawer guide 100, depicted in FIG. 4, relatively high bending moments and/or torques may result from the weight force of the drawer 102, which deflect an, in relation to the extension direction 132, front end 156 of the drawer-side guidance rail 108 of the vertical guidance unit 124 in the movement direction 150.

The front end 156 of the drawer-side guidance rail 108 of the vertical guidance unit 124 is hereby moved in particular downward in substantially vertical direction 158.

If the two guidance units 112 were now tightly and immovably coupled to each other, then this movement of the front end 156 of the drawer-side guidance rail 108 of the vertical guidance unit 124 would be transmitted to the front end 156 of the drawer-side guidance rail 108 of the lateral guidance unit 128.

Due to the different alignment of the lateral guidance unit 128 in relation to the vertical guidance unit 124, this would lead to an undesired transverse load of the lateral guidance unit 128 which in turn could impair the function thereof.

It is therefore preferably ensured by means of the coupling device 134 that the front end 156 of the drawer-side guidance rail 108 of the lateral guidance unit 128 is not loaded in vertical direction 158, even in the case of high load of the drawer 102.

Rather, only an immovable fixing along the extension direction 132 as well as in at least approximately horizontal direction 160 is achieved by way of the two coupling elements 136*a* of each one pair of coupling elements 136*a*.

Thus in particular weight forces may be decoupled from lateral guidance forces by means of the coupling device 134.

Even large weight loads can thus be reliably absorbed while preserving an optimal lateral guidance.

The drawer guide 100 is thus particularly suited for relatively wide drawers 102 in which the drawer guides 100 arranged on both sides on the same for guiding the drawer 102 are spaced relatively far apart from each other and comparatively have a small extension length and/or a small extension path. In drawers 102 of that kind, when using conventional drawer guides 100, it could result in impairment of function, among other things in undesired movement blockages, due to tilting.

However, the described embodiment of a drawer guide 100 may preferably ensure a reliable, laterally-stable extension and insertion movement, even with such drawer 102, as a result of the combination of vertical guidance unit 124, lateral guidance unit 128, and coupling device 134.

In a concrete embodiment, the drawer guide 100 is used as a part of a combination 162, for example.

The combination 162 preferably comprises two drawer guides 100, one carcass 104, as well as a drawer 102 which is moveable relative to the carcass 104 by means of the drawer guides 100.

A width B of the drawer 102 is preferably at least about 1.5 times, for example at least about 2 times, a length L of the drawer 102 taken along the extension direction 132.

The two drawer guides 100 are hereby preferably arranged and/or formed mirror-symmetrical to each other in relation to a vertical longitudinal center plane of the drawer 102, running along the extension direction 132.

In a further embodiment, however, provision may also be made for two identical drawer guides 100 to be provided, wherein one drawer guide 100 is then arranged, for example, in such a way that the vertical guidance unit 124 is arranged over the lateral guidance unit 128, while the further drawer guide 100 is arranged such that the vertical guidance unit 128 is arranged under the lateral guidance unit 128.

REFERENCE NUMERAL LIST

100 drawer guide
102 drawer
104 carcass
106 carcass-side guidance rail
108 drawer-side guidance rail
110 central rail
112 guidance unit
114 rail back
116 leg
118 rolling body track
120 rolling body
122 ball
124 vertical guidance unit
126 plane
128 lateral guidance unit
130 plane
132 extension direction
134 coupling device
136 coupling element
136*a* drawer-side coupling element
136*k* carcass-side coupling element
138 vertical section
140 horizontal section
142 upper side
144 pin
146 receptacle
148 through-opening
150 movement direction
152 drawer receptacle
154 stiffening rib
156 front end
158 vertical direction
160 horizontal direction
162 combination
B width
L length

What is claimed is:

1. Drawer guide for guiding a drawer which is extendable out of a carcass in an extension direction, comprising:

a guidance unit configured as a vertical guidance unit and a guidance unit configured as a lateral guidance unit, the two guidance units each comprising a carcass-side guidance rail and a drawer-side guidance rail mounted on rolling bodies, and a coupling device coupling the two guidance units to each other, wherein the coupling device comprises two or more than two coupling elements which are brought or able to be brought into engagement with each other for coupling two guidance rails and which are moveable relative to each other in one or more spatial directions.

2. Drawer guide in accordance with claim 1, wherein:

the coupling device comprises one or more further coupling elements;

the carcass-side guidance rails of the two guidance units are connected to each other by means of the one or more further coupling elements of the coupling device so as to be immovable in relation to the extension direction, and/or the drawer-side guidance rails of the two guidance units are connected to each other by means of the two or more than two coupling elements of the coupling device so as to be immovable in relation to the extension direction.

3. Drawer guide in accordance with claim 1, wherein:

the coupling device comprises one or more further coupling elements;

the carcass-side guidance rails of the two guidance units are connected to each other by means of the one or more further coupling elements of the coupling device so as to be immovable in relation to a spatial direction aligned perpendicular to the extension direction, and/or the drawer-side guidance rails of the two guidance units are connected to each other by means of the two or more than two coupling elements of the coupling device so as to be immovable in relation to a spatial direction aligned perpendicular to the extension direction.

4. Drawer guide in accordance with claim 1, wherein:

the drawer-side guidance rails of the two guidance units are connected to each other by means of the coupling device so as to be movable in relation to a spatial direction aligned perpendicular to the extension direction.

5. Drawer guide in accordance with claim 1, wherein:

the coupling device comprises one or more further coupling elements which are fixed on both sides on rail backs of the carcass-side guidance rails, and/or the coupling device comprises one or more further coupling elements which are fixed on both sides on rail backs of the drawer-side guidance rails.

6. Drawer guide in accordance with claim 1, wherein:

one of the two or more than two coupling elements comprises a pin, and a further one of the two or more than two coupling elements has a through-opening for accommodating and/or guiding the pin.

7. Drawer guide in accordance with claim 1, wherein the coupling device comprises one or more further coupling elements which each have one or more stiffening ribs.

8. Drawer guide in accordance with claim 1, wherein:

the guidance rails of the vertical guidance unit each have at least one rail back which each connects two legs of the respective guidance rail to each other, and the rail backs of the guidance rails of the vertical guidance unit are aligned at least approximately vertical.

9. Drawer guide in accordance with claim 1, wherein:

the guidance rails of the lateral guidance unit each have at least one rail back which each connects two legs of the respective guidance rail to each other, and the rail backs of the guidance rails of the lateral guidance unit are aligned transverse to a vertical direction.

10. Drawer guide in accordance with claim 1, wherein the lateral guidance unit is arranged entirely beneath the vertical guidance unit.

11. Combination, comprising:

a carcass, a drawer which is extendable out of the carcass in an extension direction, and two drawer guides for accommodating and guiding the drawer, each drawer guide comprising:

a guidance unit configured as a vertical guidance unit and a guidance unit configured as a lateral guidance unit, the two guidance units each comprising a carcass-side guidance rail and a drawer-side guidance rail mounted on rolling bodies, and a coupling device coupling the two guidance units to each other, wherein the coupling device comprises two or more than two coupling elements which are brought or able to be brought into engagement with each other for coupling two guidance rails and which are moveable relative to each other in one or more spatial directions.

12. Combination in accordance with claim 11, wherein the two drawer guides are formed and/or arranged mirror-symmetrical to each other in relation to a vertical center plane of the drawer, running parallel to the extension direction.

* * * * *